US005888177A

United States Patent [19]

Lin

[11] Patent Number: 5,888,177

[45] Date of Patent: Mar. 30, 1999

[54] SWINGING AND STEPPING EXERCISER

[76] Inventor: Ting Fung Lin, 12F-1, No. 83, Suei Yuan Road, Taipei, Taiwan

[21] Appl. No.: 96,862

[22] Filed: Jun. 12, 1998

[51] Int. Cl.[6] ..... A63B 22/00; A63B 23/04

[52] U.S. Cl. ..... 482/57; 482/62; 482/51

[58] Field of Search ..... 482/51, 52, 53, 482/57, 62, 79, 80, 146, 147

[56] References Cited

U.S. PATENT DOCUMENTS

| | | | |
|---|---|---|---|
| 4,555,109 | 11/1985 | Hartmann | 482/62 |
| 4,586,706 | 5/1986 | Chen | 482/62 |
| 5,545,111 | 8/1996 | Wang et al. | 482/53 |
| 5,645,512 | 7/1997 | Yu | 482/53 |
| 5,749,809 | 5/1998 | Lin | 482/52 |
| 5,779,598 | 7/1998 | Lee | 482/51 |

*Primary Examiner*—Stephen R. Crow

[57] ABSTRACT

An exerciser includes a base having a front pivot shaft and a rear pivot axle. A post has a lower portion rotatably secured to the base and a bevel gear secured to the bottom. Another bevel gear is secured on the pivot shaft and engaged with the bevel gear of the post for allowing the post to be rotated by the bevel gears. A pair of foot supports are supported on the base and each has a front portion pivotally coupled to the pivot shaft for rotating the pivot shaft and to rotate the post via the bevel gears. The rear portions of the foot supports are coupled to the base by cranks.

3 Claims, 2 Drawing Sheets

SWINGING AND STEPPING EXERCISER

BACKGROUND OF THE INVENTION

1. Field of the Invention

The present invention relates to an exerciser, and more particularly to a swinging and stepping exerciser.

2. Description of the Prior Art

Two typical stepping exercisers are disclosed in U.S. Pat. Nos. 5,545,111 to Wang et al. and 5,645,512 to Yu and comprise a complicated structure for coupling the handle to the foot supports and for allowing the handle to be rotated by the foot supports. However, the structures are complicated such that the manufacturing costs are greatly increased.

The present invention has arisen to mitigate and/or obviate the afore-described disadvantages of the conventional stepping exercisers.

SUMMARY OF THE INVENTION

The primary objective of the present invention is to provide a swinging and stepping exerciser which includes a greatly simplified structure for allowing the user to conduct both swinging and stepping exercises and for decreasing the manufacturing cost of the exerciser.

In accordance with one aspect of the invention, there is provided an exerciser comprising a base including a front portion having a pivot shaft provided thereon and including a rear portion, a post including a lower portion rotatably secured to the base, a first coupling member secured to the post and rotated in concert with the post, a second coupling member secured on the pivot shaft and engaged with the first coupling member for allowing the second coupling member to rotate the post via the first coupling member, a pair of foot supports supported on the base and each including a front portion and a rear portion, and means for coupling the foot supports to the pivot shaft and to rotate the pivot shaft and to actuate the second coupling member to rotate the post via the first coupling member.

The coupling means includes a pair of beams each having an upper portion secured to the pivot shaft and each having a lower portion pivotally secured to the front portion of the foot support. The first coupling member and the second coupling member are bevel gears engaged with each other.

A supporting means or a further coupling means is further provided for supporting or for coupling the rear portions of the foot supports to the rear portion of the base, and includes a pivot axle rotatably secured on the rear portion of the base, and a pair of cranks secured the rear portions of the foot supports to the pivot axle for allowing the rear portions of the foot supports to be rotated about the pivot axle in a cyclic action.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
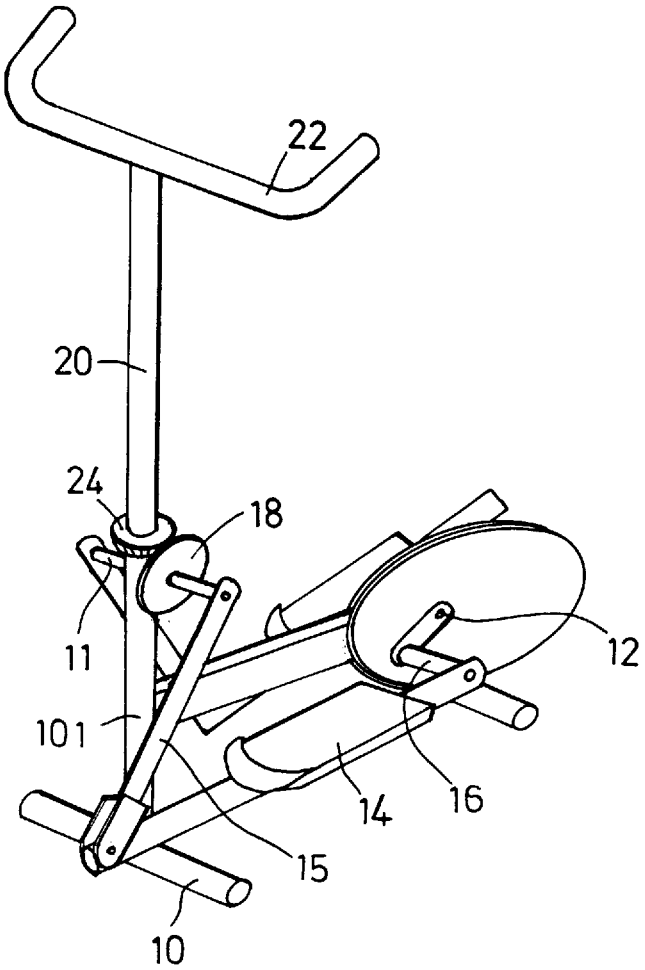
FIG. 1 is a perspective view of an exerciser in accordance with the present invention.
Figure 2:
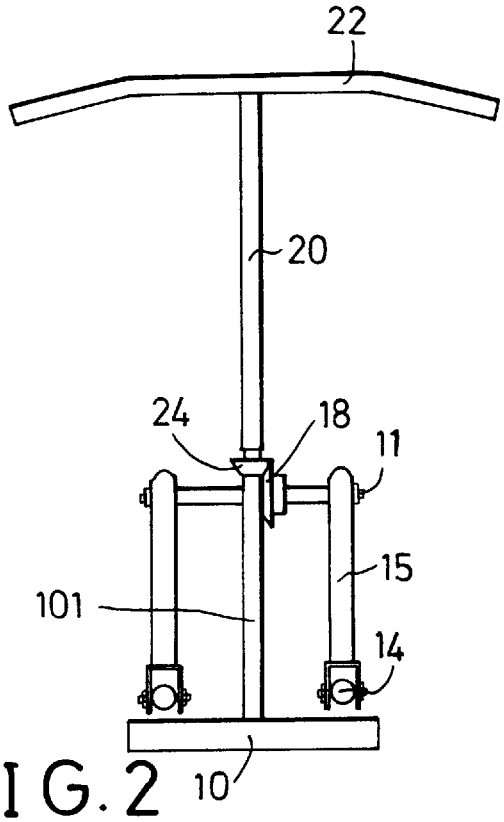
FIG. 2 is a front view of the exerciser.

Referring to the drawings, and initially to FIGS. 1 and 2, a swinging and stepping exerciser in accordance with the present invention comprises a base 10 including an extension 101 and a post 20 having a lower portion rotatably secured in the extension 101 and having a handle 22 provided on top of the post 20. The post 20 may also be rotatably secured to the base 10 without the extension 101. A coupling member, such as a bevel gear 24 is secured on the lower portion of the post 20. The base 10 includes a pivot shaft 11 provided on the front portion and a pivot axle 12 provided on the rear portion. Another coupling member, such as a bevel gear 18 is secured to the pivot shaft 11 and rotated in concert with the pivot shaft 11 and engaged with the bevel gear 24.

A pair of foot supports 14 each has a crank 16 secured to the rear portion and pivotally secured to the base 10 at the pivot axle 12, such that the rear portions of the foot supports 14 may be moved in a cyclic action. A pair of beams 15 each has an upper portion pivotally secured to the base 10 at the pivot shaft 11 and each has a lower portion pivotally coupled to the front end of the foot supports 14 such that the front portion of the foot supports 14 may be moved in a pendulum action or in a forward-rearward reciprocating action. Only one of the beams 15 is solidly secured to the pivot shaft 11 for rotating the pivot shaft 11. The other beam 15 is rotatably secured to the pivot shaft 11 and may not rotate the pivot shaft 11. The foot supports 14 are coupled together by the cranks 16 and the pivot axle 12.

In operation, the pivot shaft 11 may be rotated by the beams 15 when the foot supports 14 are stepped forward and rearward in the reciprocating action, such that the post 20 and the handle 22 may be rotated via the bevel gears 24, 18, and such that the user may conduct swinging exercise in addition to the stepping exercise.

Figure 3:
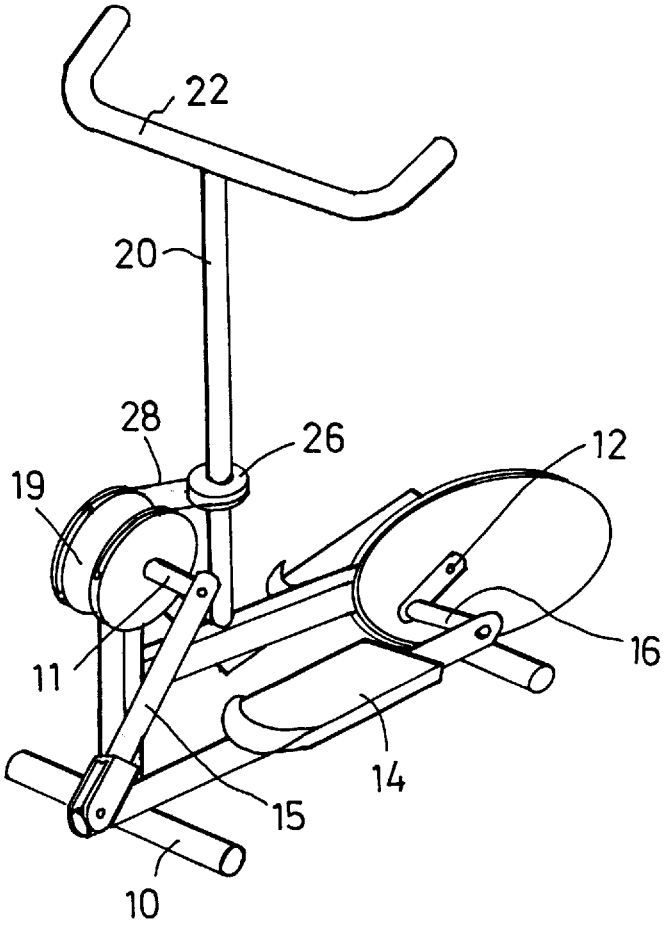
FIG. 3 is a perspective view illustrating another application of the exerciser.
Figure 4:
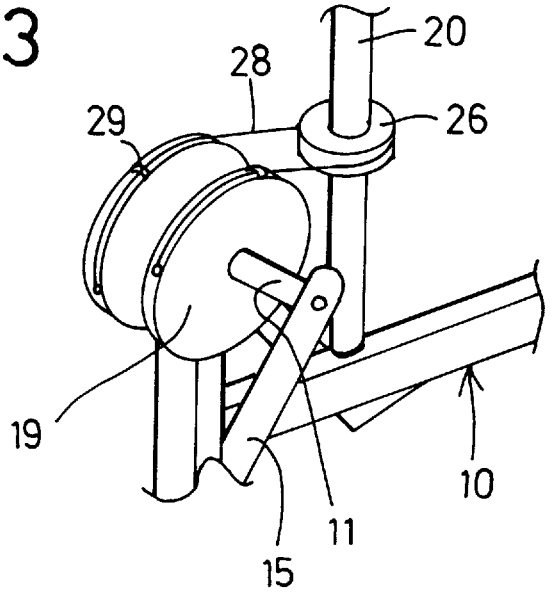
FIG. 4 is an enlarged partial perspective view of the exerciser as shown in FIG. 3.

Referring next to FIGS. 3 and 4, instead of the bevel gears 24, 18, two pulleys 19 are secured on the pivot shaft 11 and secured to the beams 15 respectively such that the pulleys 19 may be rotated by the beams 15 respectively. A follower 26 is secured to the post 20 and rotated in concert with the post 20. A cable 28 has a middle portion engaged over the follower 26 and has two ends secured to the pulleys 19 which are secured to the beams 15 respectively, such that the follower 26 and thus the post 20 may be rotated by the pulleys 19 when the pulleys 19 are rotated by the foot supports 14 via the beams 15. Two locks 29 may secure the cable 28 in place to the pulleys 19.

Accordingly, the exerciser in accordance with the present invention includes a greatly simplified structure for allowing the user to conduct both swinging and stepping exercises and for decreasing the manufacturing cost of the exerciser.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

a base including a front portion having a pivot shaft provided thereon and including a rear portion, a post including a lower portion rotatably secured to said base, a first coupling member secured to said post and rotated in concert with said post, a second coupling member secured on said pivot shaft and engaged with said first coupling member for allowing said second coupling member to rotate said post via said first coupling member, a pair of foot supports supported on said base and each including a front portion and a rear portion, and means for coupling said foot supports to said pivot shaft and to rotate said pivot shaft and to actuate said second coupling member to rotate said post via said first coupling member; further comprising means for coupling said rear portions of said foot supports to said rear portion of said base, said coupling means includes a pivot axle rotatably secured on said rear portion of said base, and a pair of cranks secured to said rear portions of said foot supports to said pivot axle for allowing said rear portions of said foot supports to be rotated about said pivot axle in a cyclic action.

2. The exerciser according to claim 1, wherein said coupling means includes a pair of beams each having an upper portion secured to said pivot shaft and each having a lower portion pivotally secured to said front portion of said foot support.

3. The exerciser according to claim 1, wherein said first coupling member and said second coupling member are bevel gears engaged with each other.

* * * * *